United States Patent [19]

Wingate

[11] Patent Number: 5,064,180

[45] Date of Patent: Nov. 12, 1991

[54] ELECTROSTATIC DIVERTER

[75] Inventor: Mark A. Wingate, Rochester, N.H.

[73] Assignee: Harris Graphics Corporation, Dover, N.H.

[21] Appl. No.: 507,244

[22] Filed: Apr. 9, 1990

[51] Int. Cl.[5] ..... B42C 1/04

[52] U.S. Cl. ..... 270/47; 270/52; 270/45; 270/60; 270/51; 271/193

[58] Field of Search ..... 270/21.1, 47, 48, 49, 270/50, 51, 52, 60, 45; 271/282, 302, 303, 307, 311, 312, 193

[56] References Cited

U.S. PATENT DOCUMENTS

| | | | |
|---|---|---|---|
| 3,323,794 | 6/1967 | Brandt | 271/193 |
| 3,346,253 | 10/1967 | Paschke | 271/193 |
| 3,999,454 | 12/1976 | Tiso | 270/21.1 |
| 4,077,519 | 3/1978 | Huber | 271/193 |
| 4,190,241 | 2/1980 | Krueger | 270/47 |
| 4,893,803 | 1/1990 | Peterson | 270/47 |

*Primary Examiner*—Edward K. Look
*Assistant Examiner*—Therese M. Newholm
*Attorney, Agent, or Firm*—Herbert L. Lerner; Laurence A. Greenberg

[57] ABSTRACT

A folder of a web-fed rotary printing machine includes a device for separating a stream of signatures into a plurality of secondary streams thereof having a device for applying an electrostatic charge to a signature, two diverter cylinders disposed alongside one another and carrying thereon electrostatically chargeable elements extending substantially parallel to respective axes of the diverter cylinders, a device for conducting the signature to the diverter cylinders, and a device for removing the signature from the diverter cylinders and for further guiding the signature to a delivery.

14 Claims, 2 Drawing Sheets

Fig. 1
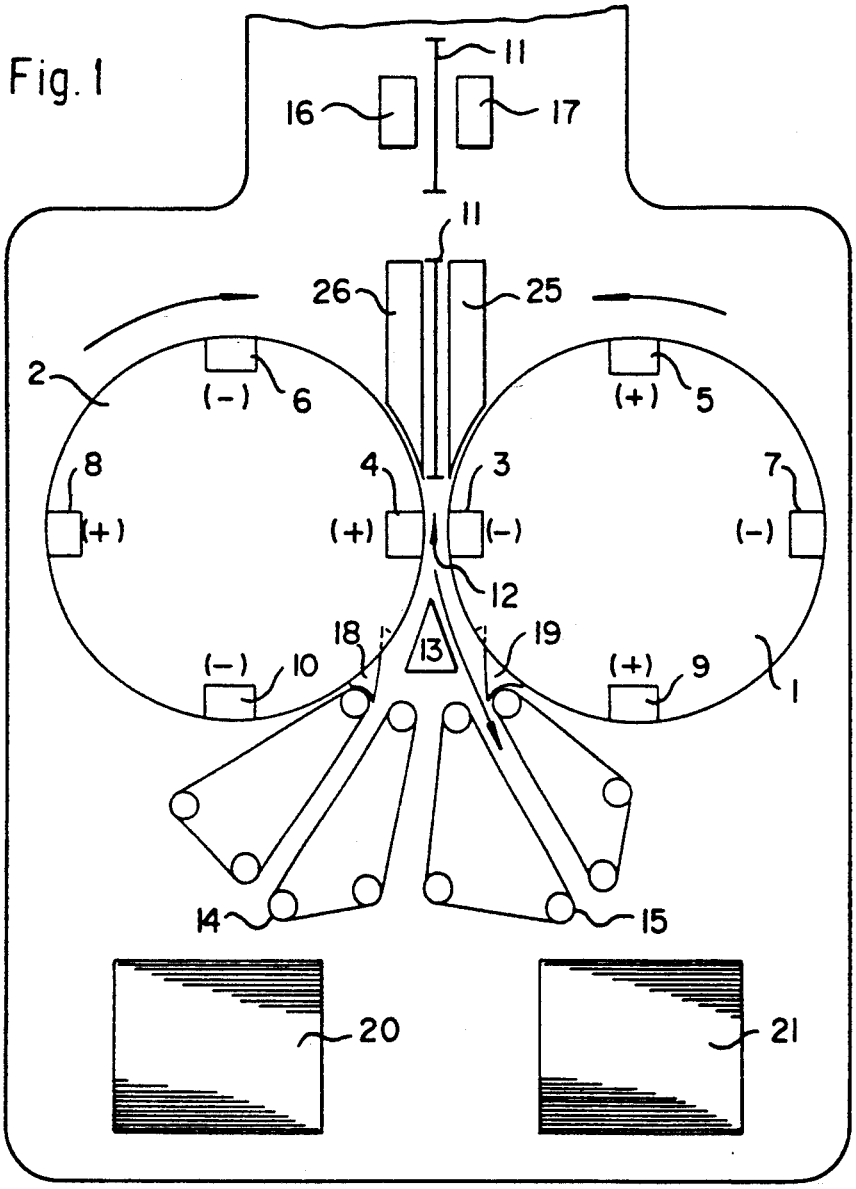
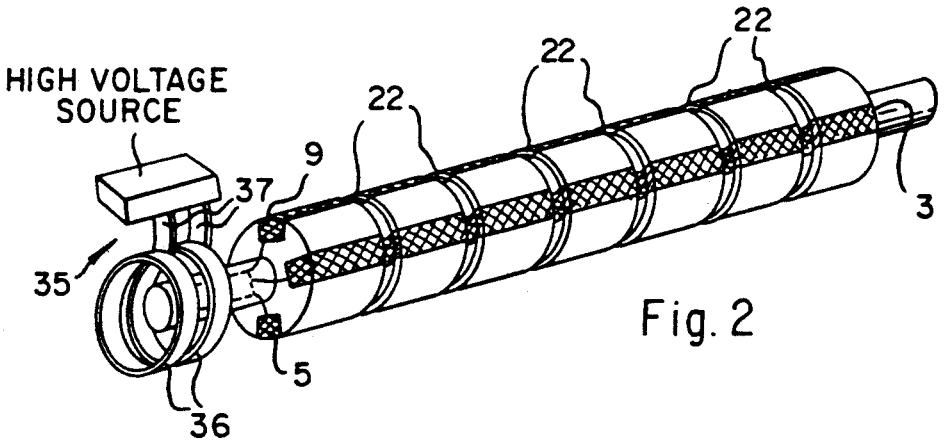
Fig. 2

ELECTROSTATIC DIVERTER

The invention relates to an electrostatic diverter and, more particularly, to such a diverter which follows the folding equipment in a folder for a web-fed rotary printing machine.

After a paper web passing through a web-fed rotary printing press has been printed, it is fed to a folder or folding unit in which processing of the printed product (folding, cutting and sorting) occurs.

The gist of the invention is the diversion of the printed copy or signature which permits the stream of signatures conducted through the folder to be divided or sorted into a plurality of signature streams for the purpose of effecting a so-called split delivery of the signatures.

The diversion of a stream of signatures has been effected heretofore, for example, by feeding the signature stream to a diverter which alternatingly guides the individual signatures in various directions.

In U.S. Pat. No. 3,894,479, the stream of signatures is fed by a folding drum to a diverter which is constructed so that it can guide the stream of signatures in two directions. The leading edge of the respective signature is diverted by the diverter in a respective predetermined direction.

A disadvantage of the foregoing heretofore-known device is that the leading edge of the signature initially impacts on the diverter thereof, which can result in damage to the signature. Furthermore, with this type of signature diversion, the leading edge of the signature is without any direct guidance, because the signature is not held at the leading edge thereof. The signature is thus loosely shoved over the diverter. Difficulties in the further transport of the paper signature can thereby occur which may bring the entire transport system to a halt. Often, a limited or reduced processing speed is thus produced due to congestion and dog-ears, which result from fixed parts which are used, such as diverters, guides, superstructure and the like.

It is accordingly an object of the invention to avoid the foregoing disadvantages of the state of the art, and to optimize signature transport at the signature diversion location, as well as during further transport following thereafter. More particularly, it is an object of the invention to provide a diverter which is of pinless construction.

Further objects of the invention are to provide an electrostatic diverter which exerts no mechanical action on the leading edge of a signature which might otherwise damage the signature, reduces the noise which would otherwise be caused by mechanical grippers or pins, and achieves an improved accuracy of transfer of the signature.

With the foregoing and other objects in view, there is provided, in accordance with the invention, in a folder of a web-fed rotary printing machine, a device for separating a stream of signatures into a plurality of secondary streams thereof, the device comprising means for applying an electrostatic charge to a signature, two diverter cylinders disposed alongside one another and carrying thereon electrostatically chargeable elements extending substantially parallel to respective axes of the diverter cylinders, means for conducting the signature to the diverter cylinders, and means for removing the signature from the diverter cylinders and for further guiding the signature to a delivery.

In accordance with another feature of the invention, the diverter cylinders, respectively, are formed with a casing having an outer cylindrical surface formed with channels extending in circumferential direction of the outer cylindrical surface, and grippers for the signature engageable in the channels.

In accordance with a further feature of the invention, the diverter cylinders, respectively, are formed with a casing having a outer cylindrical surface formed with channels extending in circumferential direction of the outer cylindrical surface, and strippers for the signature engageable in the channels.

In accordance with an added feature of the invention, the electrostatically chargeable elements carried by the diverter cylinders are alternately chargeable with a positive and a negative charge.

In accordance with again another feature of the invention, there is provided a signature transporting cylinder located downstream from the diverter cylinders in a travel direction of the signature, the transporting cylinder carrying electrostatically chargeable elements.

In accordance with again a further feature of the invention, there is provided in a folder of a web-fed rotary printing machine, a device for dividing a stream of signatures, comprising means for applying an electrostatic charge of a given type to each of the signatures; a pair of diverter cylinders having shafts disposed alongside and spaced from on another so as to define a gap between the diverter cylinders; mutually spaced electrostatically chargeable elements disposed at a respective peripheral surface of the diverter cylinders and extending substantially parallel to the axes thereof; means for electrostatically charging elements of each of the diverter cylinders so that the respective elements alternately have the given type of charge and a type of charge opposite thereto; means for rotating the diverter cylinders so that alternatingly an element of the given type of charge of one of the diverter cylinders is located at the gap simultaneously with an element of the opposite type of charge of the other of the diverter cylinders; means for guiding each of the signatures, with an electrostatic charge of the given type applied thereto, into the gap between the diverter cylinders so that the respective electrostatically charged signature is attracted to the element of the opposite type of charge and repelled by the element with the given type of charge then located at the gap, and means for removing the respective signature from the respective diverter cylinder then having the element thereof of opposite charge type located at the gap and further guiding the signature to a delivery.

In accordance with again an added feature of the invention, the signature-removing means comprise strippers or grippers located outside the diverter cylinders and having respective ends receivable in circumferential grooves formed in the peripheral surfaces of the diverter cylinders.

In accordance with again an additional feature of the invention, the signature-removing means comprise a device for reversing the charge of the element to which the respective electrostatically charged signature has been attracted for a given period of time, whereby the signature is then repelled from the element.

In accordance with yet an added feature of the invention, there is provided a transporting cylinder located adjacent to and downstream from at least one of the diverter cylinders in travel direction of the signatures, and having electrostatically chargeable elements disposed at a peripheral surface thereof and extending substantially parallel to a rotational axis thereof, the transporting cylinder being rotatable at a rate and in a phase relative to a rate and phase of rotation of the respective diverter cylinder so that when the signature is repelled by the respective element of the respective diverter cylinder, it is attracted and slowed down by an element of the transporting cylinder.

In accordance with yet another feature of the invention, the means for electrostatically charging the elements of a respective diverter cylinder comprise a slip ring assembly mounted on the shaft of the respective diverter cylinder.

In accordance with yet a further feature of the invention, there is provided a slip ring assembly which comprises at least two slip rings secured to and rotatable with the shaft of the respective diverter cylinder, and respective fixed brushes slidingly engaging the slip rings.

In accordance with a concomitant feature of the invention, there are provided means for connecting a high-voltage source to the slip rings so that one of the rings has a given type of electrostatic charge applied thereto, and the other of the rings has a type of electrostatic charge applied thereto which is opposite to the given type of electrostatic charge.

Other features which are considered as characteristic for the invention are set forth in the appended claims.

Although the invention is illustrated and described herein as embodied in an electrostatic diverter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic side elevational view of an electrostatic diverter followed by signature conveyor belts;

FIG. 2 is a perspective view of one of the cylinders shown in FIG. 1, considerably reduced in size.

Figure 3:
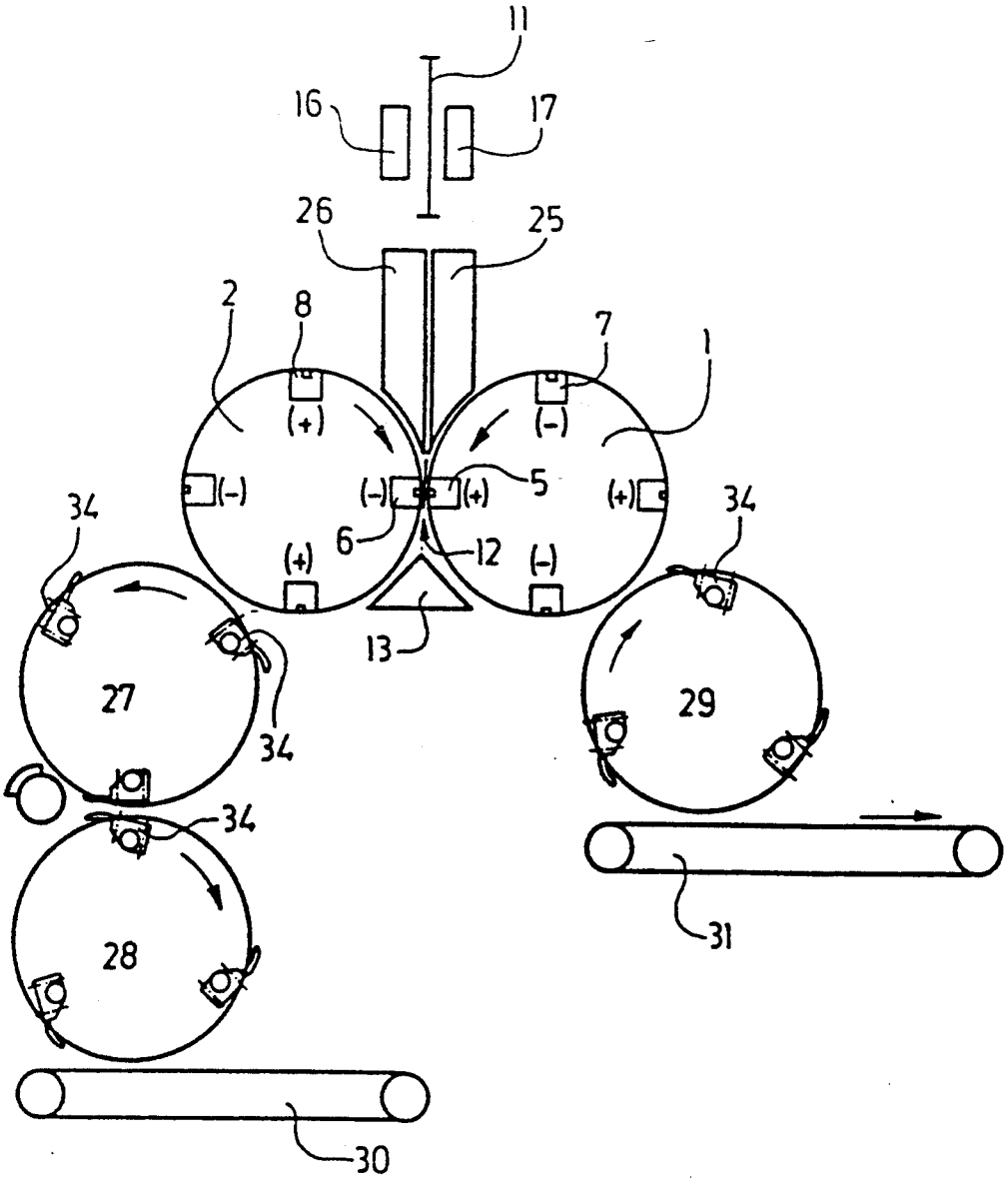
FIG. 3 is a view like that of FIG. 1 of another embodiment of the electrostatic diverter followed by transport cylinders and conveyor belts.

Referring now to the drawings and, first, particularly to FIGS. 1 and 2 thereof, there are shown therein two diverter cylinders 1 and 2 having a gap 12 therebetween to which signatures 11, which had been processed in a folder unit, are fed, after passing between a pair of electrostatic bars 16 and 17. A high-voltage source is connected to the bars 16 and 17 so as to apply, for example, a positive electrostatic charge to a leading edge portion of successive signatures 11. The diverter cylinders 1 and 2 are provided with elements 3 to 10 which are carriers of electrostatic charges.

The signature 11 which is transported into the gap 12 and which has had a positive charge applied thereto, is attracted by the element 3 which has been provided with a negative charge, for example. The leading edge of the signature 11 thus lies continuously on the element 3 and firmly held thereby. Due to rotation of the diverter cylinder 1, the signature 11 is diverted, from the previous direction in which it was being transported, into a direction corresponding to the direction of rotation of the diverter cylinder 1 and guided at an opposite side thereof by a stationary steeple 13. After the signature 11 has travelled a given distance with the diverter cylinder 1, i.e., a distance covering approximately 45° of the circumference of the diverter cylinder 1, in the illustrated example, the leading edge of the signature 11 engages a signature stripper 19 which lifts the signature 11 away again from the element 3 and, guided by the steeple 13, simultaneously conducts it to a signature conveyor belt 15.

The signature conveyor belt 15 then transports the signature 11 to a delivery pile 21.

Through the rotation of the diverter cylinders 1 and 2 (through 90° in the illustrated example), the elements 5 and 6 are disposed opposite one another at the gap 12. It is, of course, possible to have more than four electrostatically charged elements distributed about the periphery of the diverter cylinder 1, in which case the respective rotational angle would be suitably smaller depending upon the number of elements. The oncoming signature 11, which had been charged positively by the electrodes 16 and 17, is then attracted by the element 6 which carries a negative charge, and is repelled by the element 5 which has a type of charge like that of the signature 11, i.e. positive, for example. The full length of the leading edge of the signature 11 lies on the element 6 and is held thereby. The diversion of the signature 11 then occurs in the rotational direction of the diverter cylinder 2. After a given rotational angle (more than 90° in the illustrated example), the leading edge of the signature 11 is lifted away from the outer cylindrical surface of the diverter cylinder 2 by a signature stripper 18, and simultaneously fed to a signature conveyor belt 14. The signature conveyor belt 14 transports the signature 11 to a delivery pile 20.

The elements 3 and 10 are electrically charged via a conventional slip ring assembly 35 having slip rings 36 (FIG. 2) rotatingly carried by a shaft of the respective cylinder 1, 2 and suitably charged by a high-voltage source via suitable stationary brushes 37 slideably engaged by the slip rings 36 which are electrically connected to the respective elements 3, 5, 7, 9 (FIG. 2). Such a slip ring assembly is of the type available, for example, from Gleason Reel Corp of Mayville, Wis.

In order for the signature strippers 18 and 19 to be able to lift the leading edge of the signature 11 from the elements 3 and 10 without damage, in the embodiment of the invention shown in FIG. 2, the outer cylindrical surface of the diverter cylinder 1, 2 is formed with several circumferential channels 22 in which the respective signature strippers 18, 19 are received without necessarily or only grazingly making contact with the bottom or the sides of the channels 22. Due to this arrangement, the signatures 11 slide smoothly from the diverter cylinders 1 and 2 over the respective signature strippers 18 and 19 to the respective conveyor belts 14 and 15.

Another embodiment of the invention, as aforementioned, is shown in FIG. 3 wherein the signature 11 is transported into the gap 12 between the diverter cylinders 1 and 2. The element 6 provided with a negative electrostatic charge attracts the leading edge of the signature 11 which is positively charged. The leading edge of the signature 11 thus lies on the element 6 and is held thereby due to the opposite electrostatic charge applied thereto and due to the repulsion by the like charge applied thereto from the elements. A high voltage source produces the required holding or retaining force which is adjusted in intensity in accordance with the requirements.

The signature 11 is drawn away from the gap 12 (less than 90° in the illustrated example) in the rotational direction of the diverter cylinder 2, and fed to a transfer cylinder 27. The steeple or guide element 13 is disposed below the gap 12 (as viewed in FIG. 3), and serves to support or assist in the guidance of the signature 11. The transfer cylinder 27 is furnished with grippers 34 which remove the signature 11 from the diverter cylinder 2 and feed it to a delivery cylinder 28 which deposits the signature 11 on a conveyor belt 30.

The next following signature 11 entering the gap 12 is attracted by an element 7, which happens to be located in the vicinity of the gap 12 at that instant of time, and is fed to a delivery cylinder 29 in accordance with the rotational direction of the diverter cylinder 1. The delivery cylinder 29 is provided with grippers 34 which remove the signature 11 from the diverter cylinder 1, reduce the speed of travel of the signature 11, and deposit it on the conveyor belt 31.

I claim:

1. In a folder of a web-fed rotary printing machine, a device for separating a stream of signatures into a plurality of secondary streams thereof, the device comprising means for applying an electrostatic charge of a given type to a signature, two rotatable diverter cylinders disposed alongside one another and carrying thereon electrostatically chargeable elements extending substantially parallel to respective axes of said diverter cylinders and being electrically charged alternatingly with a charge of said given type and with a charge opposite to said given type at a gap between said diverter cylinders, means for conducting the signature to said diverter cylinders, and means for removing the signature from said diverter cylinders and for further guiding the signature to a delivery.

2. Separating device according to claim 1, wherein said electrostatically chargeable elements carried by said diverter cylinders are alternately chargeable with a positive and a negative charge.

3. Separating device according to claim 1, including a signature transporting cylinder located downstream from said diverter cylinders in a travel direction of the signature, said transporting cylinder carrying electrostatically chargeable elements.

4. In a folder of a webfed rotary printing machine, a device for separating a stream of signatures into a plurality of secondary streams thereof, the device comprising means for applying an electrostatic charge to a signature, two diverter cylinders disposed alongside one another and carrying thereon electrostatically chargeable elements extending substantially parallel to respective axes of said diverter cylinders, means for conducting the signature to said diverter cylinders, and means for removing the signature from said diverter cylinders and for further guiding the signature to a delivery, said diverter cylinders, respectively, being formed with a casing having an outer cylinder surface formed with channels extending in circumferential direction of said outer cylindrical surface, and grippers for the signature engageable in said channels.

5. In a folder of a web-fed rotary printing machine, a device for separating a stream of signatures into a plurality of secondary streams thereof, the device comprising means for applying an electrostatic charge to a signature, two diverter cylinders disposed alongside one another and carrying thereon electrostatically chargeable elements extending substantially parallel to respective axes of said diverter cylinders, means for conducting the signature to said diverter cylinders, and means for removing the signature from said diverter cylinders and for further guiding the signature to a delivery, said diverter cylinders, respectively, being formed with a casing having an outer cylindrical surface formed with channels extending in circumferential direction of said outer cylindrical surface, and strippers for the signature engageable in said channels.

6. In a folder of a web-fed rotary printing machine, a device for dividing a stream of signatures, comprising means for applying an electrostatic charge of a given type to each of the signatures; a pair of diverter cylinders having shafts disposed alongside and spaced from one another so as to define a gap between said diverter cylinders; mutually spaced electrostatically chargeable elements disposed at a respective peripheral surface of said diverter cylinders and extending substantially parallel to said axes thereof; means for electrostatically charging elements of each of said diverter cylinders so that the respective elements alternately have the given type of charge and a type of charge opposite thereto; means for rotating said diverter cylinders so that alternatingly an element of the given type of charge of one of said diverter cylinders is located at said gap simultaneously with an element of the opposite type of charge of the other of said diverter cylinders; means for guiding each of the signatures, with an electrostatic charge of said given type applied thereto, into said gap between said diverter cylinders so that the respective electrostatically charged signature is attracted to the element of the opposite type of charge and repelled by the element with the given type of charge then located at said gap, and means for removing the respective signature from the respective diverter cylinder then having the element thereof of opposite charge type located at said gap and further guiding the signature to a delivery.

7. Electrostatic diverter according to claim 6, wherein said signature-removing means comprise strippers located outside said diverter cylinders and having respective ends receivable in circumferential grooves formed in the peripheral surfaces of said diverter cylinders.

8. Electrostatic diverter according to claim 6, wherein said signature-removing means comprise grippers located outside said diverter cylinders and having respective ends receivable in circumferential grooves formed in the peripheral surfaces of said diverter cylinders.

9. Electrostatic diverter according to claim 6, wherein said signature-removing means comprise a device for reversing the charge of the element to which the respective electrostatically charged signature has been attracted for a given period of time, whereby the signature is then repelled from said element.

10. Electrostatic diverter according to claim 9, including a transporting cylinder located adjacent to and downstream from at least one of said diverter cylinders in travel direction of the signatures, and having electrostatically chargeable elements disposed at a peripheral surface thereof and extending substantially parallel to a rotational axis thereof, said transporting cylinder being rotatable at a rate and in a phase relative to a rate and phase of rotation of the respective diverter cylinder so that when the signature is repelled by the respective element of the respective diverter cylinder, it is attracted and slowed down by an element of said transporting cylinder.

11. Electrostatic diverter according to claim 6, wherein said means for electrostatically charging the elements of a respective diverter cylinder comprise a slip ring assembly mounted on the shaft of the respective diverter cylinder.

12. Electrostatic diverter according to claim 11, wherein said slip ring assembly comprises at least two slip rings secured to and rotatable with the shaft of the respective diverter cylinder, and respective fixed brushes slidingly engaging said slip rings.

13. Electrostatic diverter according to claim 12, including means for connecting a high-voltage source to said slip rings so that one of said rings has a given type of electrostatic charge applied thereto, and the other of said rings has a type of electrostatic charge applied thereto which is opposite to said given type of electrostatic charge.

14. In a folder of a web-fed rotary printing machine, a device for separating a stream of signatures into a plurality of secondary streams thereof, the device comprising means for applying an electrostatic charge of a given type to a signature, a pair of diverter members having revolvable endless surfaces disposed alongside one another and defining a gap therebetween, electrostatically chargeable elements carried by said endless surfaces at spaced locations thereon, said elements being charged alternatingly with a charge of said given the and a charge of a type opposite to said given type, means for revolving said endless surfaces so that respective elements of said diverter members having electrostatic charges of said given and said opposite types, respectively, are located simultaneously at said gap, means for conducting the signatures to said pair of diverter members, and means for removing the signatures from said diverter members and for further guiding the signatures to a delivery.

* * * * *